United States Patent [19]

Conti

[11] 4,440,216

[45] Apr. 3, 1984

[54] FINNED HEAT EXCHANGER TUBE

[75] Inventor: Raul J. Conti, Palo Alto, Calif.

[73] Assignee: Lockheed Missiles & Space Company, Inc., Sunnyvale, Calif.

[21] Appl. No.: 397,579

[22] Filed: Jul. 12, 1982

Related U.S. Application Data

[63] Continuation of Ser. No. 121,734, Feb. 18, 1980, abandoned.

[51] Int. Cl.[3] ..... F28D 3/04

[52] U.S. Cl. ..... 165/117; 165/183

[58] Field of Search ..... 165/111–117, 165/179, 186, 183; 62/513–515; 202/185 R, 185 B; 138/121, 173

[56] References Cited

U.S. PATENT DOCUMENTS 1,658,025 2/1928 Alexander ..... 165/110

3,025,685 3/1962 Whitlow ..... 165/110

4,031,602 6/1977 Cunningham ..... 165/179

FOREIGN PATENT DOCUMENTS 1220975 1/1971 United Kingdom ..... 138/173

1493804 11/1977 United Kingdom ..... 165/110

*Primary Examiner*—William R. Cline

*Assistant Examiner*—Theophil W. Streule, Jr.

*Attorney, Agent, or Firm*—Thomas H. Olson; Rodger N. Alleman

[57] ABSTRACT

An improved finned heat exchanger tube wherein the upper circumferential portions of the fins are foreshortened to enhance axial movement of liquid introduced onto the top of the finned tube. Accordingly, the liquid can gravitate both axially and circumferentially of the finned tube and thoroughly wet the entire external surface thereof.

5 Claims, 4 Drawing Figures

FINNED HEAT EXCHANGER TUBE

This application is a continuation, of application Ser. No. 121,734, filed 2/18/80 now abandoned.

BACKGROUND OF THE INVENTION

1. Field of the Invention

This invention relates to an improved finned heat exchanger tube and more particularly to a tube configuration that affords uniform distribution of liquid over the exterior surface of the finned tube.

2. Description of the Prior Art

Typifying an environment in which a finned heat exchanger tube is employed is that disclosed in U.S. Pat. No. 3,180,405 to Hinde, which includes a condenser wherein a plurality of horizontally extending tubes are disposed in vertically aligned rows to from an array over which a liquid flows. A fluid is circulated inside the tubes and such fluid is at a temperature different from that of liquid flowing over the exterior of the tubes so that heat energy is exchanged between the internal fluid and the external liquid.

U.S. Pat. No. 3,523,577 to Milton discloses in FIG. 7 a finned tube configuration that is widely available and widely used in heat exchanger environments.

U.S. Pat. No. 3,025,685 to Whitlow discloses a finned tube wherein the fins are closely spaced to one another so that the grooves between adjacent fins causes liquid introduced into the grooves to be distributed circumferentially of the grooves by capillary action. The '685 patent also discloses a longitudinally disposed groove that traverses the circumferential grooves; the longitudinally disposed groove causes the liquid to move axially from one capillary groove to the next adjacent one so that liquid is spread axially and circumferentially throughout the entire finned surface by means of capillary action. The structure of the '685 patent performs adequately for relatively low feed rates of the liquid wetting the outer surface of the tube and for relatively small tubes. Because the patented structure relies on capillary action to wet the tube, however, it provides little or no improvement at high flow rates, especially in large heat exchangers and relatively large diameter tubes of one or more inches in diameter.

U.S. Pat. No. 2,896,426 discloses a finned heat exchanger tube which is vertically disposed when in operation. Each one of the fins has a radially extending slit so that fluid applied to the upper fins can gravitate downward through the slits to lower fins.

SUMMARY OF THE INVENTION

The present invention is employed in a finned heat exchanger tube in which the interfin spaces are too large to afford uniform wetting of the tube surface by capillary action. The fins are foreshortened at the top of the tube to form at the top a noncapillary liquid flow path axially of the tube. Accordingly, as liquid drips onto the top of the tube, it can flow freely in the interfin spaces in response to the force of gravity and can also flow axially along the noncapillary flow path so as to wet the entire external surface of the tube. Consequently, heat is efficiently exchanged between the liquid and the fluid flowing within the tube.

An object of the invention is to provide a finned tube structure that affords substantially uniform axial and circumferential distribution of liquid dripped thereon from above over the entire external surface area of the tube. This object is achieved by dimensioning the interfin spaces to avoid liquid retention due to viscous and capillary forces and by forming the axially extending flow path sufficiently large to afford free gravity induced liquid flow therealong.

Another object of the invention is to provide a method for the operation of a finned heat exchanger tube which method can be incorporated with minimum disruption of established procedures.

The foregoing together with other objects, features and advantages will be more apparent after referring to the following specification and the accompanying drawings.

DESCRIPTION OF THE PREFERRED EMBODIMENT

Figure 1:
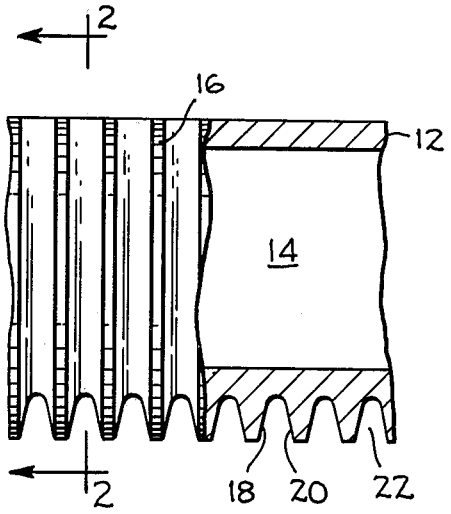
FIG. 1 is a fragmentary side view of a horizontally oriented finned tube with portions being broken away to reveal internal details.

Referring more particularly to the drawings, reference numeral 12 indicates a cylindrical or tubular shaped impervious wall which defines an internal fluid passage 14. Wall 12 is typically formed of copper, brass, or like rigid, impervious material with good heat conduction characteristics. On the external surface of wall 12 is a plurality of fins 16 which are formed of rigid heat conducting material and, as can be seen in FIG. 1, can be integral with wall 14 or can be affixed thereto in any suitable way. Fins 16 extend generally radially of the external surface of wall 12 and can be formed of individual fins that are perpendicular to fluid passage 14, or in the alternative, can be helically configured around the exterior surface of wall 12. The fins are typically of uniform size and are uniformly spaced from one another. The fins have side surfaces 18 and 20 so that between such side surfaces of adjacent fins there is defined an interfin space 22. The width or axial dimension of interfin space 22 is sufficiently large that flow within such space is free and not unduly restricted by capillary or viscous action. Accordingly, liquids introduced onto the top of the structure shown in FIGS. 1 and 2 will freely flow through the interfin spaces 22 in a circumferential direction to thoroughly wet the fins and promote excellent heat exchange between the liquid on the exterior surfaces of the fins and the fluid within passage 14.

Figure 2:
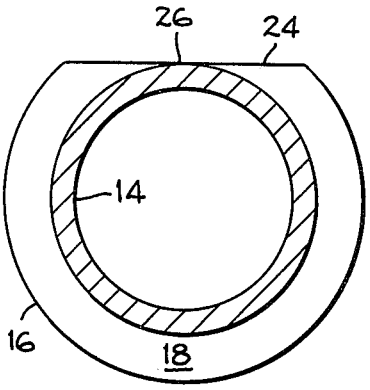
FIG. 2 is a cross-sectional view taken along line 2—2 of FIG. 1.

As seen most clearly in FIG. 2, the upper portions of fins 16 are foreshortened at a surface 24 that extends tangentially of the external surface of wall 12. Surfaces 24 on all fins 16 are coplanar, and there is an imaginary line of tangency at 26 which extends parallel to fluid passage 14.

In operation a plurality of tubes are mounted in a vertical row or array; each tube is oriented horizontally as shown in FIG. 1. A fluid is introduced into passage 14 of all tubes and a liquid is dripped onto the upper surface of the uppermost tube. The location of the dripping liquid is preferably at or near the imaginary line of tangency 26. Part of the liquid dripping on the upper exterior surface of tube 12 will gravitate circumferentially through the interfin space 22 that is directly in line with the dripping liquid. Another part of the liquid will gravitate axially because of the presence of surface 24 on the fins which radially foreshortens the fins at a circumferentially limited top portion of the fins to permit such axial flow. Consequently, the liquid will be distributed into the upper portion of all interfin spaces 22 and will thoroughly wet the external surface of the finned structure. Thus, heat exchange between the fluid flowing within internal fluid passage 14 and the liquid wetting the entire exterior surface of the structure takes place efficiently and rapidly.

Figure 3:
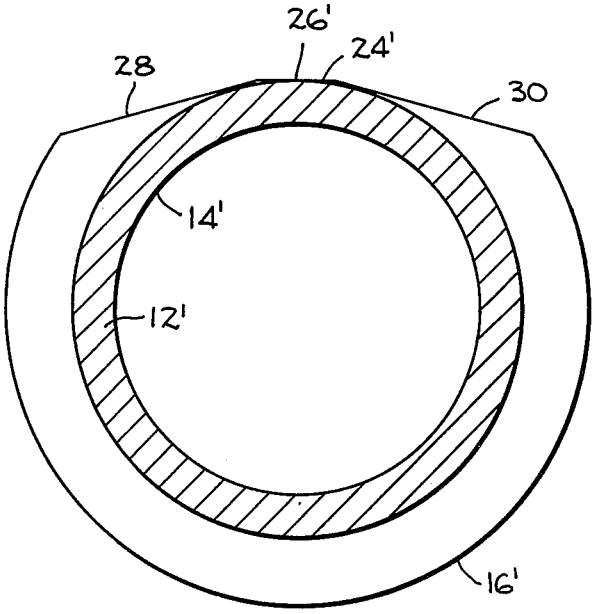
FIG. 3 is a cross-sectional view similar to FIG. 2 and showing a modification of the invention at enlarged scale.

In an alternate form of the invention shown in FIG. 3, there is a cylindrical wall 12' which defines an internal fluid passage 14' substantially as in the embodiment of FIGS. 1 and 2. There are fins 16' which extend radially outward from the external surface of wall 12'. At an upper circumferentially limited portion of each fin 16' is a foreshortened portion composed of a narrow central surface 24' which extends tangentially of the external surface of wall 12' and is symmetrical about an imaginary line of tangency 26'. Flanking surface 24' are obliquely extending lateral surfaces 28 and 30 which surfaces are also tangent to the external surface of wall 12'.

The operation of the embodiment shown in FIG. 3 is substantially the same as described hereinabove in connection with FIGS. 1 and 2. Because lateral surfaces 28 and 30 are oblique of surface 24', axial liquid flow on the exterior surface of wall 12' can proceed with less impedance so that thorough wetting of the external surface of the structure is assured. The embodiment shown in FIG. 3 lends itself well to heat exchanger environments wherein the liquid flow rate on the exterior of the structure is high.

Figure 4:
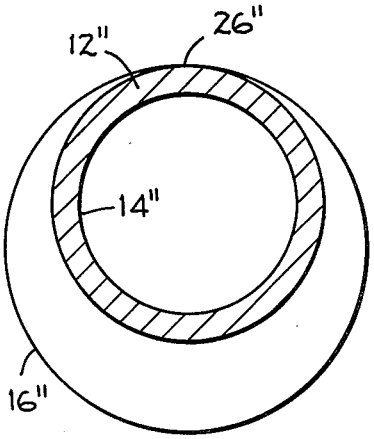
FIG. 4 is a cross-sectional view similar to FIG. 2 and showing another modification of the invention.

Still another embodiment of the invention is shown in FIG. 4 in which there is a cylindrical wall 12'' which defines an internal fluid passage 14'' in a manner similar or identical to that referred to hereinabove with respect to FIGS. 1 and 2. Rigid with the external surface of wall 12'' is a plurality of fins 16''. Fins 16'' in the embodiment shown in FIG. 4 are geometrically similar to the cross-sectional shape of the external surface of wall 12, that is, they are both circular. Of course, noncircular fins would serve the same purpose. However, fins 16'' are disposed eccentrically of the external surface of wall 14 so that at the top of the structure there is a radially foreshortened fin portion which is tangent to the exterior surface of wall 12' at an imaginary line of tangency indicated at 26''.

Operation of the embodiment of FIG. 4 is substantially identical to that described above in that a plurality of fin structures are mounted in a horizontal position and in a vertical row or array. As liquid drips onto the top of each finned tube at or near line of tangency 26'', the liquid gravitates axially and circumferentially of the external surface of the tube and thoroughly and uniformly wets the same to enhance efficient heat exchange between the fluid within central passage 14 and the liquid contacting the external surface of the tube.

In each of the three embodiments shown in the drawings, it will be noted that the imaginary lines of tangency at 26, 26' and 26'' are coincident with the uppermost point of the foreshortened fin portion. This condition tends to promote free liquid flow along the axial path formed by the foreshortened portions so that even at high liquid flow rates uniform wetting of the fin surfaces is achieved.

To recapitulate the operation of the present invention in terms of a method, substantially uniform wetting of the external surface of a finned tube by liquid introduced onto the top of the tube is achieved by providing a wall defining a closed internal fluid passage and having a plurality of substantially parallel fins projecting substantially radially from the wall externally of the passage, forming along a line of tangency at the top of the external surface of the wall a radially foreshortened portion at a circumferentially limited region of each fin, orienting the structure so that the passage and the line of tangency are substantially horizontal, and introducing liquid at or near the line of tangency. It will be clear from the foregoing description that as the liquid is introduced it moves both axially and circumferentially so that the external surface of the wall and the fins is uniformly and thoroughly wetted so as to enhance heat exchange between the liquid and the fluid within the central passage.

Although several embodiments of the invention have been shown and described, it will be obvious that other adaptations and modifications can be made without departing from the true spirit and scope of the invention.

What is claimed is:

1. An article of manufacture for affording heat transfer between a fluid and a liquid comprising a wall defining a closed smooth internal fluid passage, a plurality of substantially parallel fins projecting substantially radially from said wall externally of said passage and being integral with said wall, said fins being spaced from one another to form a plurality of substantially parallel interfin spaces, said interfin spaces being dimensioned to avoid substantial liquid retention therein, said fins each having a radially foreshortened portion at a circumferentially limited region to form a continuous noncapillary liquid flow path that extends along an imaginary longitudinal line on the external surfaces of said wall and parallel to said passage thereby to establish free gravity induced liquid communication between said interfin spaces when said article is oriented so that said passage is substantially horizontal, each said foreshortened portion being defined by a surface wherein said surfaces of all said fins are coplanar and extend substantially tangentially of the external surface of said wall and transversely of said imaginary line, said article being oriented with said liquid flow path at the top so that liquid can flow axially thereof on to said fin surfaces and between said fins.

2. An article according to claim 1 wherein said coplanar surfaces extend on both sides of an imaginary line of tangency on the external surface of said wall extending parallel to said passage, said coplanar surfaces being flanked by first and second lateral surfaces that extend obliquely of said coplanar surfaces.

3. An article according to claim 2 wherein said lateral surfaces extend substantially tangentially of the external surface of said wall.

4. An article according to claim 1 wherein said fins are disposed eccentrically of said passage defining wall, said fins each having a perimeter, said fins being disposed so that said foreshortened portion is formed at an imaginary line of tangency between the external surface of said wall and said perimeter.

5. An article according to claim 1 wherein said foreshortened portion is defined by a fin surface that is tangent to the external surface of said wall along an imaginary line of tangency, said fin surface being formed so that when said tube is oriented with said foreshortened portion upward the uppermost portion of said fin surface is coincident with the line of tangency.

* * * * *